US006581353B2

(12) United States Patent
Augustine

(10) Patent No.: US 6,581,353 B2
(45) Date of Patent: Jun. 24, 2003

(54) SUPPORT FOR A WALL ABOVE A FLOATING SLAB

(76) Inventor: Ronald J. Augustine, 3625 Juanita Rd., Fort Collins, CO (US) 80524

( * ) Notice: Subject to any disclaimer, the term of this patent is extended or adjusted under 35 U.S.C. 154(b) by 10 days.

(21) Appl. No.: 09/972,620

(22) Filed: Oct. 9, 2001

(65) Prior Publication Data

US 2003/0068205 A1 Apr. 10, 2003

(51) Int. Cl.[7] ..... E04B 1/38

(52) U.S. Cl. ..... 52/698; 52/272; 52/293.3; 52/239

(58) Field of Search ..... 52/293.3, 698, 52/272, 243.1, 238.1, 239, 241, 242, 573.1; 248/679; 403/408.1; 256/59, 65.14

(56) References Cited

U.S. PATENT DOCUMENTS

| | | | | | |
|---|---|---|---|---|---|
| 2,210,441 | A | * | 8/1940 | Bachman | 52/297 |
| 3,453,789 | A | * | 7/1969 | Stephenson | 52/126.3 |
| 3,638,376 | A | * | 2/1972 | Howes et al. | 52/126.4 |
| 3,861,103 | A | | 1/1975 | Rasmussen | |
| 4,462,192 | A | * | 7/1984 | Fisher | 52/240 |
| 4,563,849 | A | | 1/1986 | Mangal | |
| 4,860,516 | A | * | 8/1989 | Koller et al. | 52/480 |
| 5,040,345 | A | | 8/1991 | Gilmour | |
| 5,313,752 | A | | 5/1994 | Hatzinikolas | |
| 5,357,727 | A | | 10/1994 | Duckworth | |
| 5,471,805 | A | | 12/1995 | Becker | |
| 5,653,078 | A | * | 8/1997 | Kies et al. | 52/698 |
| 5,699,643 | A | | 12/1997 | Kinard | |
| 5,755,066 | A | | 5/1998 | Becker | |
| 5,906,080 | A | | 5/1999 | diGirolamo | |

* cited by examiner

*Primary Examiner*—Carl D. Friedman
*Assistant Examiner*—Brian E. Glessner
(74) *Attorney, Agent, or Firm*—Donn K. Harms

(57) ABSTRACT

A support device for stabilizing a hanging wall above a floating slab. In areas having expansive soils, basement slabs and surface slabs will rise and fall with increases and decreases in soil moisture. Walls mounted on such slabs would be damaged when the slab rises. Therefore, such walls are made to hang from overhead structures such as joists with the bottom wall end spaced from the slab. The support device is mounted on a bottom plate within such a wall above a base plate fastened to the slab. The device includes a bracket having a flange for fastening to the bottom plate and an tubular extension extending downwardly through a hole in the bottom plate. A sleeve slidingly fits through the tubular extension and includes at least one nail (preferably two nails) extending through the sleeve and engaging the base plate. When the nails are hammered into the base plate, the wall can move up and down with the slab, but is stabilized against lateral movement due to lateral forces on the wall.

10 Claims, 2 Drawing Sheets

SUPPORT FOR A WALL ABOVE A FLOATING SLAB

FIELD OF THE INVENTION

This invention relates to the provision of lateral support for "floating walls" above a floating concrete slab.

BACKGROUND OF THE INVENTION

Expansive or swelling soils are present at many locations across the United States and around the world. Expansive soils expand when the water content of the soil increases. Expansive soils create the greater problems when they are present in semi-arid climates where a water deficit normally exist prior to the development of residential communities.

When a residential community is built in an area of expansive soils, the soil environment is dramatically changed. Much of the ground surface, which was previously open to the atmosphere, is covered by houses, driveways, streets and sidewalks. These pavements and strictures limit the amount of moisture that can evaporate from the ground. Additionally, homeowners typically plant a grass yard or create other landscaping that requires irrigation during the summer season. For example, it is not uncommon for homeowners in semi-arid climates, which normally receive less than 20 inches of annual precipitation, to add an additional 40 to 60 inches of water to their lawns during the summer season.

This combination of covering the soil, which reduces natural evaporation, and adding additional irrigation water, combined with the tendency of normally dry soils to draw the water below the surface before it can evaporate greatly increases the moisture levels in the soil below buildings. The increased soil moisture causes the soil to swell or heave upward. As the expansive soils swell, they exert upward forces on surface structures such as streets, buried utilities and, most significantly, concrete slab floors. These lifting forces are powerful enough to actually lift such surface structures.

To accommodate upward heaving of basement slab-on-grade floor, building codes typically require the use of slip joints between the basement slab and the foundation walls of a house to allow the basement slab to rise and fall relative to the foundation walls. The foundation walls are supported on caissons that are preferably anchored to bedrock below the level of soil wetting to make the walls immune to swelling soils. Thus, the slip joints provide tolerance for swelling soils and allow the slab to "float".

Because the slip joints allow the concrete slab to rise and fall as the moisture content of the under lying soil varies, any walls constructed immediately above the floating slab must be constructed in such a manner that when the slabs rise the walls are not deformed or crushed between the concrete slab and the house above. Building codes typically require that all walls constructed on concrete floors that are designed as "floating slabs" also be "floated."

A "floating wall" is typically constructed of vertical studs that are secured only to the joists of the floor above with a gap between the lower end of the wall and the floor. Because the floor joists are typically supported by the concrete foundation walls which are anchored to bedrock below the level of the expansive soil, they do not rise or fall with the floating slab. As the floor rises and falls, the gap between the wall lower end and the slab will narrow and widen correspondingly.

Since a "floating" wall has no vertical support at its base, the bottom of the floating wall must be stabilized against lateral movement. Typically, a nail is driven through a hole (having a diameter greater that the nail) in the bottom plate of the wall and into a plate fastened to the floating wall. As the slab rises and falls, the nail will slide upward and downward in the bottom plate hole, while resisting, to a degree, sideways forces exerted against the wall.

While this arrangement is generally accepted under local building codes, the lateral support provided is minimal and any significant lateral force applied to the floating wall will cause the wall to deflect, resulting in damage to the floating wall.

Wall construction techniques have been developed to accommodate seismic movement, such as that disclosed by Rasmussen in U.S. Pat. No. 3,861,103 and by Gilmour in U.S. Pat. No. 5,040,345, neither of these has application to a stud wall hung from joists above a floating slab.

Thus, there is a continuing need for improved need for improved lateral support system for walls hung above a floating slab that are inexpensive, easily installed and have greater resistance to lateral forces.

SUMMARY OF THE INVENTION

The above-noted problems, and others, are overcome by a device for providing lateral support to the base of a wall hung over a floating slab, which comprises an elongated fitting having at least one longitudinal tube, each for receiving a nail having a length greater than the longitudinal tube, a bracket having an opening for receiving the elongated fitting in a slidable relationship parallel to said nail, means for securing the bracket to a bottom plate in a hanging wall adjacent to the bottom of the hanging wall so that said nails may be driven downwardly into an adjacent baseplate secured to a floating slab.

For maximum lateral support, two parallel longitudinal tubes and two nails are preferred. While additional nails may be used, the slightly greater lateral support is generally not sufficient to justify the additional cost, complexity and difficulty in driving closely adjacent nails.

Although the bracket can be fastened to the bottom plate in any suitable manner, a flange extending generally perpendicular to the bracket at the nail head end with means to fasten the flange to the bottom plate with the longitudinal tube(s) extending through the bottom plate provides optimum strength and ease of installation.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
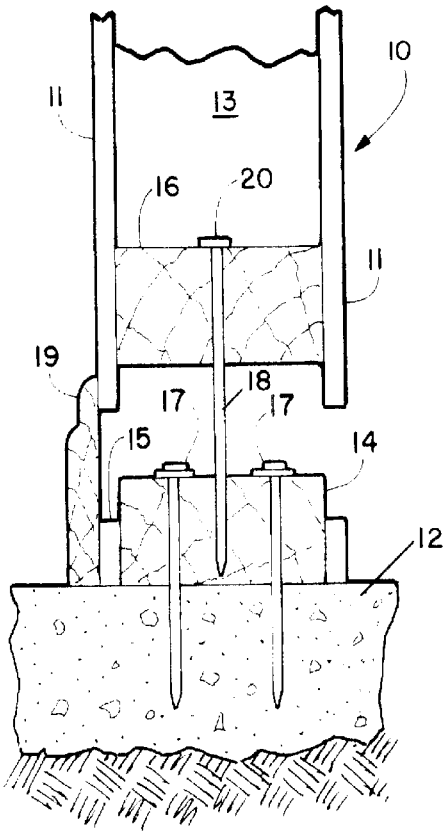
PRIOR ART FIGURE 1
FIG. 1 is an elevation section view through a wall using the lateral support system of the prior art.

Referring to FIG. 1, there is seen a section through a hanging wall 10. Wall 10 may have any suitable structure.

Conventionally, wall 10 will have two faces 11 formed from wall board or plaster on lath and will contain spaced vertical studs 13. The lower end of wall 10 ends a predetermined distance above floating slab 12 of the sort described above. The upper end of wall 10 is firmly fastened to joists or other conventional structure (not shown) well above slab 12.

A base plate 14, typically a conventional wooden plank such as a 2×4, is fastened to slab 12 directly below the location of wall 10 before the wall is assembled. Any suitable fasteners may be used, such as concrete nails 17 or studs of the sort available from the Ramset Company.

A bottom plate 16 is formed by fastening an appropriately sized board, typically a 2×4, within wall 10 close to the bottom end of the wall. A long nail 18 is then inserted through a pre-drilled hole 20 so at to allow nail 18 to move up and down as slab 12 moves up or down.

Baseboards 19 may be used to cover the gap between the lower end of wall 10 and slab 12. Baseboards 19 are fastened, such as by conventional nails or screws, only to base plate 14 (with an intermediate strip 15, if needed, to allow for the thickness of facing 11. Baseboards 19 will slide up and down along wall 10 with rise and fall of slab 12.

If light lateral forces are applied to wall 10, nail 18 will resist lateral displacement. However, even moderate lateral forces may cause nail 18 to bend, allowing wall 10 to an extent likely to cause at least cosmetic damage (cracks and the like) to wall 10. Since wall 10 and nail 18 will be in place for very long periods, possibly the life of the building, such damage is quite likely.

Figure 2:
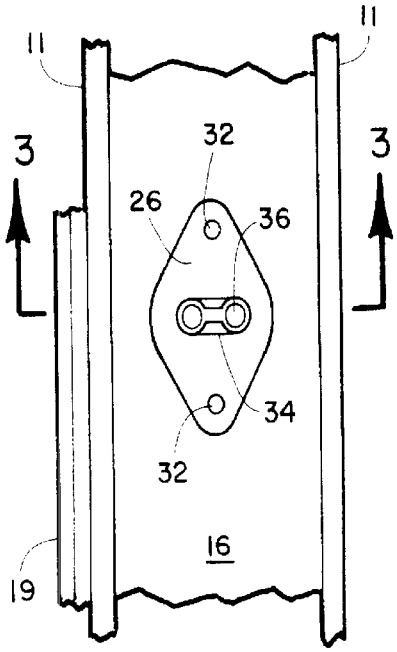
FIG. 2 is a plan section view through a wall showing the lateral support system of this invention.
Figure 3:
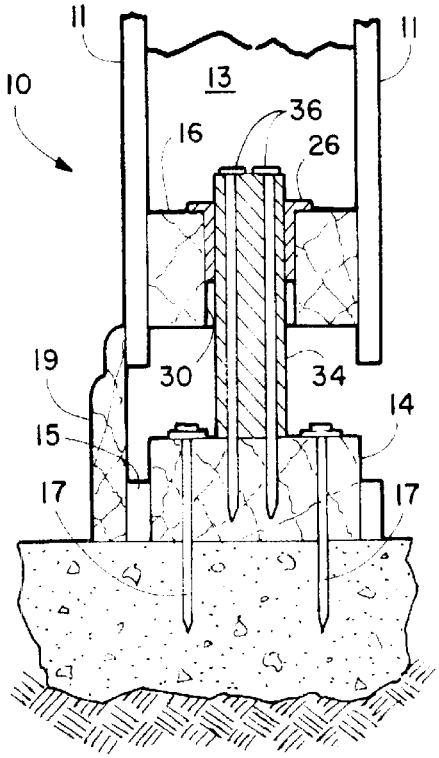
FIG. 3 is an elevation section view through the wall, taken on line 3—3 in FIG. 2.
Figure 4:
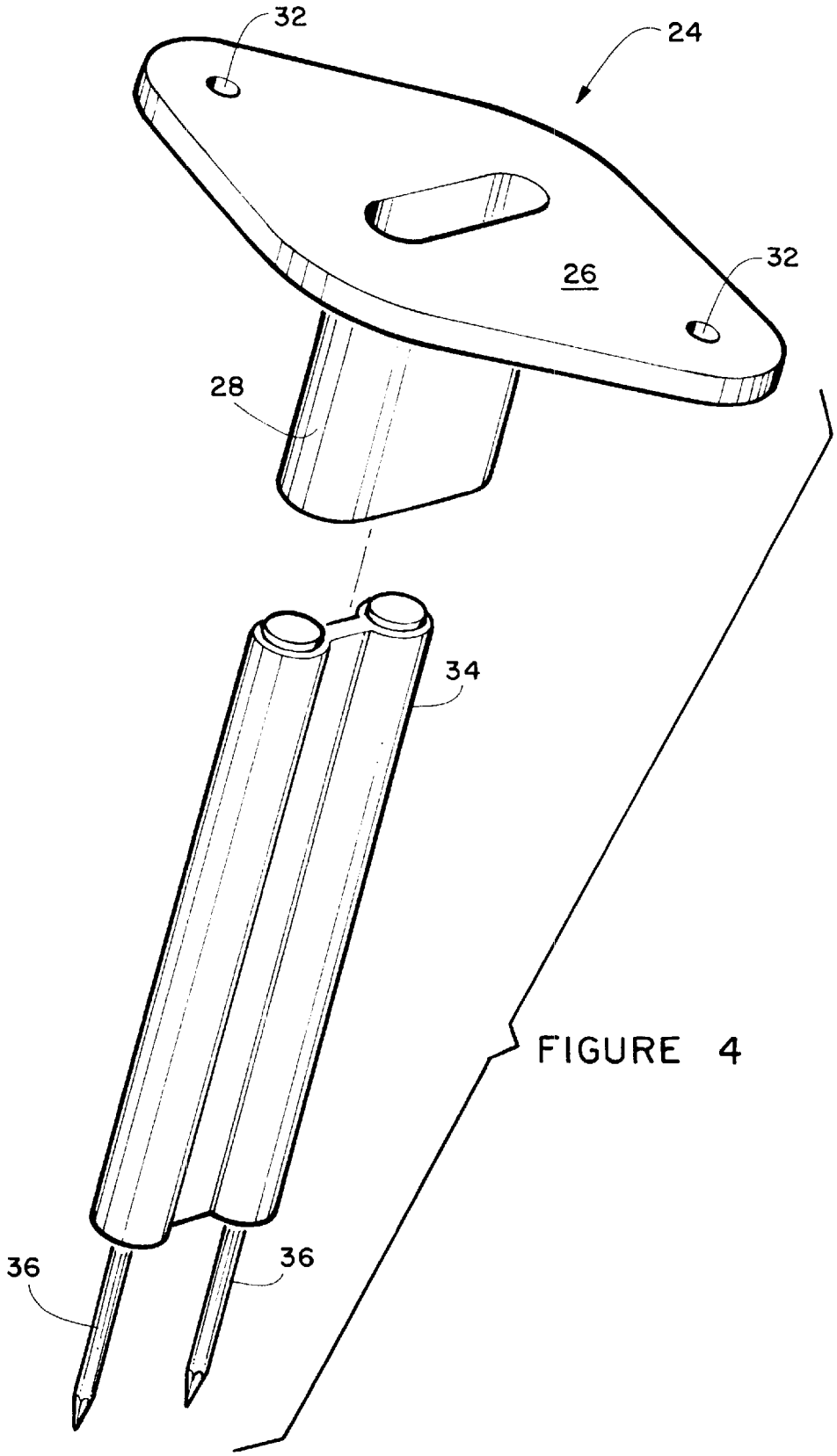
FIG. 4 is an exploded perspective view of the lateral support system of this invention.

An arrangement making a hanging wall much more resistant to lateral forces on the wall and limit damage is shown in plan view in FIG. 2 vertical section in FIG. 3. Support device 22, as shown in exploded perspective in FIG. 4, is mounted in a wall and slab arrangement of the same sort as that shown in FIG. 1.

Hanging wall 10, slab 12 and base plate 14 are the same conventional structure as in FIG. 1, with the same components. However, FIGS. 2 and 3 illustrate the use of the support device shown in FIG. 4 in place of nail 18 to provide much greater lateral support.

As seen in FIGS. 2 and 3, support device 22 includes a unitary device including a bracket 24 having an outwardly extending flange 26 and a tubular extension 28 extending through the center of the flange and lying generally perpendicular thereto.

As seen in FIGS. 2 and 3, tubular extension 28 extends through a corresponding hole in bottom plate 16, which may have any suitable cross section, generally round. Flange 26 lies against the upper surface of bottom plate 16 and is fastened by any suitable means, such as nails or screws, to the bottom plate through holes 32 (FIG. 4).

An elongated sleeve 34 fits though tubular means in a sliding relationship. At least one nail 36 (the preferred two nails being shown) extends though a central hole in tubular extension 28 in a tight, friction fit. Nails 36 can be hammered into base plate 14, preferably until the end of sleeve 34 contacts the base plate. While any suitable number of nails 36 may be used, for an optimum combination of resistance against lateral forces on wall 10 and ease of emplacement, two generally parallel nails 36 are preferred. Nails 36 are spaced apart a suitable distance, with a web connecting the two spaced tubes receiving the nails.

Any suitable material may be used for bracket 24 and sleeve 34. Typically materials include high strength plastic, fiber reinforced plastics and metals such as aluminum or steel which provide strength, flexibility and manufacturing efficiency. Nails may be any conventional nails of any desired width and length. If desired, screws could be used in place of nails 36, however, screws are more time consuming to emplane and do not provide any significant advantage over the nails shown.

Other variations, applications and ramifications of the present invention will occur to those skilled in the art upon reading this disclosure. Those are intended to be included within the scope of this invention, as defined in the appended claims.

I claim:

1. A support device for stabilizing a hanging wall above a floating slab, which comprises:

a bracket for fitting in an opening in a hanging wall bottom plate adjacent to a base plate;

means for fastening said bracket to said bottom plate;

elongated tubular means on said bracket having a centerline for orienting toward said bottom plate;

an elongated sleeve slidable in said tubular means;

at least one nail extending through said elongated sleeve and having a point extending beyond said elongated sleeve for engaging said base plate;

whereby said at least one nail can be hammered into said base plate.

2. The support according to claim 1 wherein said means for fastening said bracket to said bottom plate comprises a flange generally perpendicular to said elongated tubular means and at least one penetrating fastener for fastening said flange to said bottom plate.

3. The support according to claim 2 wherein said elongate sleeve extends away from one side of said flange and is configured to fit in said opening.

4. The support according to claim 1 wherein said at least one nail consists of two spaced, approximately parallel, nails.

5. The support according to claim 4 wherein said sleeve comprises two approximately parallel tubes secured together in a spaced relationship by an intermediate web.

6. The support according to claim 1 wherein said bracket and said elongated sleeve, bracket and elongated tubular means are formed from a material selected from the group consisting of plastic, fiber reinforced plastic, aluminum and steel.

7. A support device for stabilizing a hanging wall above a floating slab, which comprises:

a bracket including a flange for engaging a hanging wall bottom plate and an elongated tubular means for fitting in an opening in a hanging wall bottom plate adjacent to a base plate;

means for fastening said bracket to said bottom plate;

an elongated sleeve slidable in said tubular means;

two nails extending through said elongated sleeve, each having a point extending beyond said elongated sleeve for engaging a said base plate;

whereby said two nails can be hammered into said base plate.

8. The support according to claim 7 wherein said sleeve comprises two approximately parallel tubes secured together in a spaced relationship by an intermediate web.

9. The support according to claim 7 wherein said bracket and said elongated sleeve, bracket and elongated tubular means are formed from a material selected from the group consisting of plastic, fiber reinforced plastic, aluminum and steel.

10. A support device for stabilizing a hanging wall above a floating slab, which comprises:

an elongated sleeve including two tubes for holding two nails in a spaced, approximately parallel relation;

a nail in each of said tubes, each nail having a pointed end extending a predetermined distance beyond said sleeve;

a bracket having a central tubular means and an outwardly extending flange, said tubular means configured to receive said elongated sleeve in a sliding relationship.

* * * * *